US011050203B2

(12) United States Patent
Czarnecki et al.

(10) Patent No.: US 11,050,203 B2
(45) Date of Patent: Jun. 29, 2021

(54) ADAPTER SYSTEM FOR CONNECTING ELECTRICAL SOURCES TO LOADS

(71) Applicant: Reliance Controls Corporation, Racine, WI (US)

(72) Inventors: Neil A. Czarnecki, Mount Pleasant, WI (US); Benjamin F. Flegel, Racine, WI (US); Joseph Kampschroer, Whitefish Bay, WI (US); Chris Flegel, Oak Creek, WI (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 16/911,430

(22) Filed: Jun. 25, 2020

(65) Prior Publication Data

US 2021/0066869 A1 Mar. 4, 2021

Related U.S. Application Data

(63) Continuation-in-part of application No. 16/734,983, filed on Jan. 6, 2020, now abandoned.

(60) Provisional application No. 62/892,638, filed on Aug. 28, 2019.

(51) Int. Cl.

| | |
|---|---|
| ***H01R 31/06*** | (2006.01) |
| ***H01R 43/00*** | (2006.01) |
| ***H01R 13/64*** | (2006.01) |

(52) U.S. Cl.

CPC ..... *H01R 31/06* (2013.01); *H01R 13/64* (2013.01); *H01R 43/00* (2013.01)

(58) Field of Classification Search

CPC ..... H01R 31/06; H01R 13/64; H01R 13/639; H01R 13/6392; H01R 13/6395; H01R 43/00; H01R 27/00; H01R 31/005

USPC ..... 439/638

See application file for complete search history.

(56) References Cited

U.S. PATENT DOCUMENTS

| | | | | |
|---|---|---|---|---|
| 5,529,513 | A | 6/1996 | Lee | |
| 5,900,684 | A | 5/1999 | Lam | |
| 6,664,758 | B2 * | 12/2003 | Yang | H02J 7/00047 320/107 |
| 6,752,650 | B1 * | 6/2004 | Lin | H01R 13/5825 439/461 |
| 7,127,838 | B2 | 10/2006 | Menze | |
| 7,495,941 | B2 | 2/2009 | Lanni | |
| 7,544,909 | B2 | 6/2009 | Dhir | |
| 8,149,570 | B2 * | 4/2012 | Keebler | H02J 2207/40 361/622 |
| 8,668,516 | B2 * | 3/2014 | Lee | H01R 13/6691 439/489 |
| 2006/0183381 | A1 | 8/2006 | Lanni | |
| 2008/0293290 | A1 | 11/2008 | Ku et al. | |

(Continued)

*Primary Examiner* — Edwin A. Leon

(74) *Attorney, Agent, or Firm* — Boyle Fredrickson, S.C.

(57) ABSTRACT

The present inventors have recognized that locating cable adapters which may be required in electrical systems, such as between power generators and electrical inlets, may be greatly aided by applying visually striking distinguishing indicators, such as colors, molded-in patterns or shaped identifiers, shaped protrusions, and the like, at ends of each cable adapter which distinguishing indicators correspond to electrical/mechanical standards or connections of various types. This, in turn, may allow for rapid deployment of such cable adapters in the system, including from a kit.

12 Claims, 6 Drawing Sheets

(56) References Cited

U.S. PATENT DOCUMENTS

| | | | | |
|---|---|---|---|---|
| 2009/0091292 | A1* | 4/2009 | Nippear | H02J 7/0045 320/111 |
| 2010/0317222 | A1 | 12/2010 | Tom et al. | |
| 2012/0064772 | A1 | 3/2012 | Pocrass | |

* cited by examiner

ADAPTER SYSTEM FOR CONNECTING ELECTRICAL SOURCES TO LOADS

CROSS-REFERENCE TO RELATED APPLICATION(S)

This application is a continuation in part of U.S. patent application Ser. No. 16/734,983, entitled "Adapter System for Connecting Electrical Sources to Loads," filed on Jan. 6, 2020, which claims priority to U.S. Provisional Patent Application No. 62/892,638, entitled "Adapter System for Connecting Electrical Sources to Loads," filed on Aug. 28, 2019, each of which is herein incorporated by reference.

FIELD OF THE INVENTION

The present invention is directed to the field of power transmission, and more particularly, to systems and methods for adapting electrical power between sources and loads for power transmission.

BACKGROUND

The need for alternate and sometimes portable electrical power is becoming more widespread. Unfortunately, electrical products tend to suffer from a lack of standardization with respect to their electrical connections. Sources and loads can utilize many different types of electrical connections, such as National Electrical Manufacturers Association (NEMA) connectors of various types, including NEMA 14-50, NEMA Travel Trailer (TT) 30. NEMA L14-30, NEMA LS-30, NEMA L14-20, NEMA L5-20, NEMA 5-20, NEMA 5-15, and so forth. As a result, female receptacles of one type are oftentimes incompatible with male cable connectors or plugs of another type.

Consequently, when the time comes to connect a given power source, or extension cord of the given power source, to an electrical load, the probability of having an electrical power cord of the correct type available for the power source and the load may be low. Moreover, even if the correct power cord is available, finding such a power cord among numerous other power cords appearing similar, though not the same, can be difficult. What is needed is a system for efficiently adapting power sources to electrical loads having different types of electrical connections.

SUMMARY OF THE INVENTION

The present inventors have recognized that locating cable adapters which may be required in electrical systems, such as between power generators and electrical inlets, may be greatly aided by applying visually striking distinguishing indicators, such as colors, molded-in patterns or shaped identifiers, shaped protrusions, and the like, at ends of each cable adapter which distinguishing indicators correspond to electrical/mechanical standards or connections of various types. This, in turn, may allow for rapid deployment of such cable adapters in systems, including from a kit.

Specifically then, one aspect of the present invention can provide an electrical adapter system including: first and second electrical power cords, each electrical power cord having first and second ends, each end including a male plug or a female receptacle, each end being defined by a given type among multiple types in which a male plug and a female receptacle of a same type are plug compatible with one another and a male plug and a female receptacle of different types are incompatible with one another, each type corresponding to a distinguishing indicator, and each end having a distinguishing indicator indicating the given type, in which the first and second ends of the first electrical power cord and the first end of the second electrical power cord are of a same type having the same distinguishing indicators while the second end of the second electrical power cord is of a different type having a different distinguishing indicator, and in which the second end of the first electrical power cord is plug compatible with the first end of the second electrical power cord of the same type for transmitting power from the first end of the first electrical power cord to the second end of the second electrical power cord.

The present invention also provides an adapter system for efficiently adapting power sources, typically having extension cords, to electrical loads by providing a set of electrical power cord adapters in which each power cord adapter has a first end having a first pattern, color or sensory indicia for adapting to one type of electrical connection and a second end having a second pattern, color or sensory indicia, different from the first pattern, color or sensory indicia, for adapting to another type of electrical connection. This can allow a power cord adapter to connect to such an extension cord, at ends having common indicia, for adapting a given power source to a load. Such differences in indicia corresponding to differences in electrical connection types can allow an observer to visually and quickly select a power cord adapter suitable for use with an extension cord, including from a larger set of electrical power cord adapters, for adapting between a particular power source and electrical load, each requiring different types of electrical connections.

Other aspects, objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

For the purpose of illustration, there are shown in the drawings certain embodiments of the present invention. It should be understood, however, that the invention is not limited to the precise arrangements, dimensions, and instruments shown. Like numerals indicate like elements throughout the drawings. In the drawings.

While the invention is described herein in connection with certain preferred embodiments, there is no intent to limit it to those embodiments. On the contrary, the intent is to cover all alternatives, modifications and equivalents within the spirit and scope of the invention as defined by the appended claims.

DETAILED DESCRIPTION OF THE INVENTION

Figure 1:
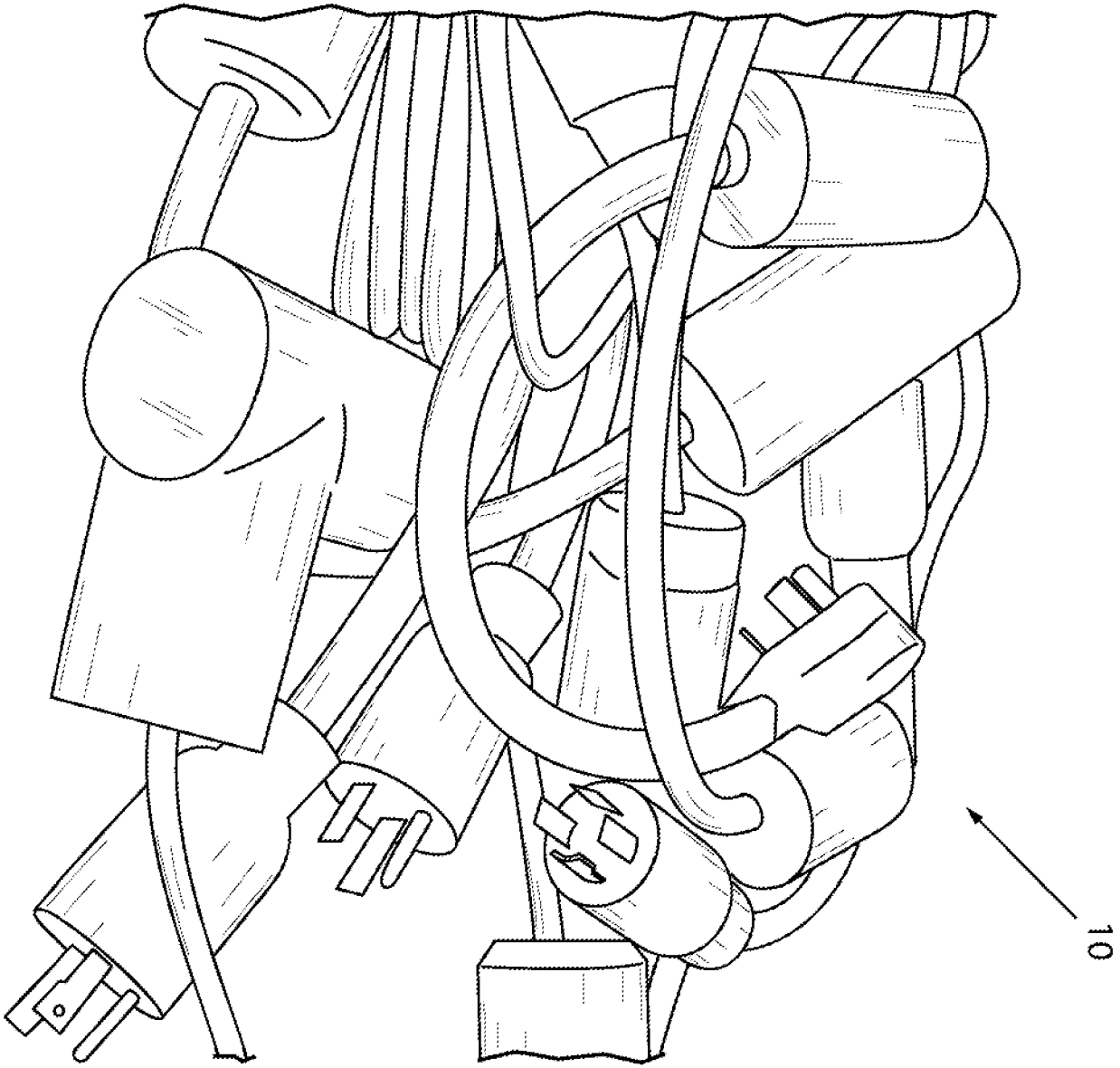
FIG. 1 (PRIOR ART)
FIG. 1 illustrates exemplar electrical power cord adapters for adapting between different types of electrical connections in the prior art.

Referring now to the drawings, and initially to FIG. 1, electrical power cord adapters 10 for adapting between different types of electrical connections are well known. However, myriad possible adapter combinations using different power cord adapters 10 exist, which can make it difficult for retailers to stock all possible combinations. Also, the task of selecting the proper power cord adapters 10 to connect between different types of electrical connections can be daunting as each connector's configuration is not always obvious to an observer.

Accordingly, the present invention provides an adapter system for more efficiently adapting power sources to electrical loads by providing one or more electrical power cord adapters in which each power cord adapter has a first end having a first pattern, color or sensory indicia (distinguishing mark) representing one type of electrical connection and a second end having a second pattern, color or sensory indicia, hereinafter simply "distinguishing mark" or "indicia," different from the first indicia, representing another type of electrical connection. Such differences in indicia corresponding to differences in electrical connection types can allow an observer to visually and quickly select a power cord adapter, including from a larger set of electrical power cord adapters, for adapting between a particular connection associated with a power source and a particular connection associated with an electrical load, each requiring different types of electrical connectors.

Figure 2A:
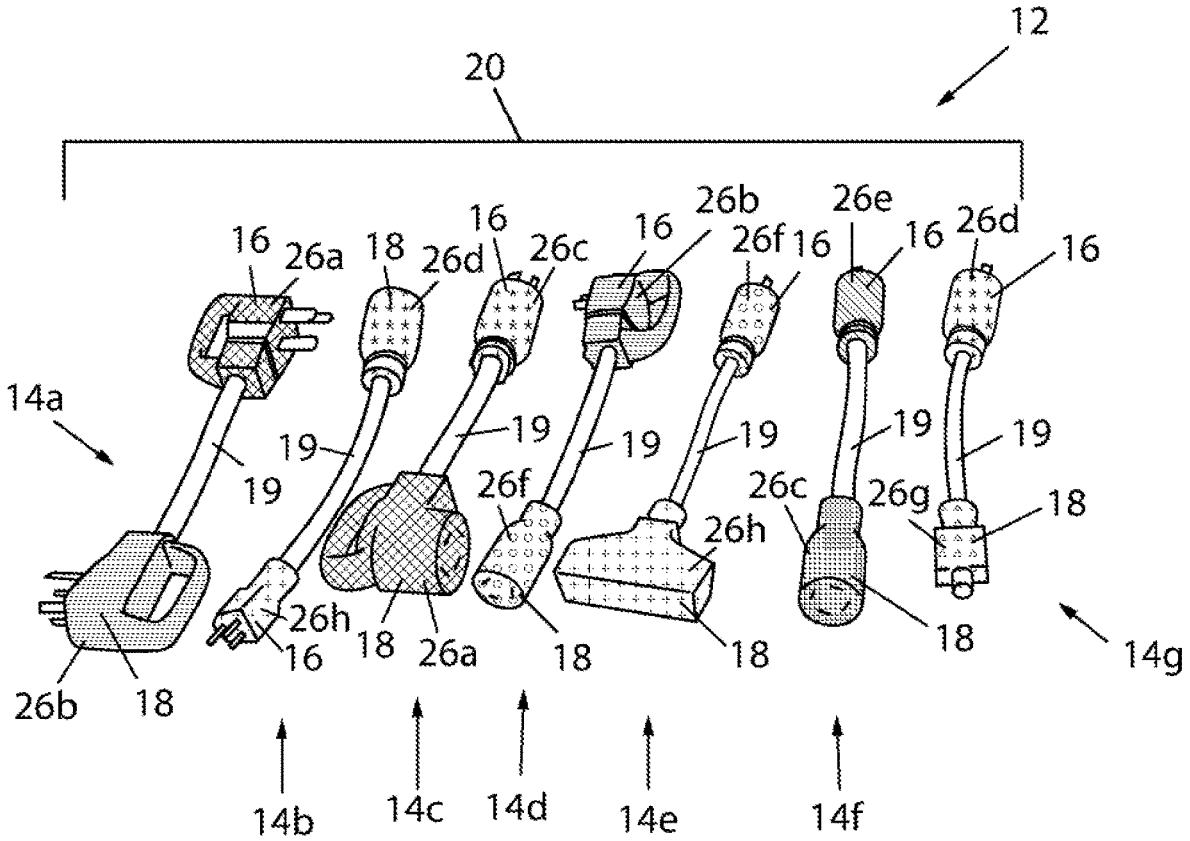
FIGS. 2A and 2B illustrate an exemplar set or kit of differing adapter power cords for adapting between different types of electrical connections in different ways according to pattern, color or sensory indicia (distinguishing mark) in accordance with an aspect of the invention.
Figure 2B:
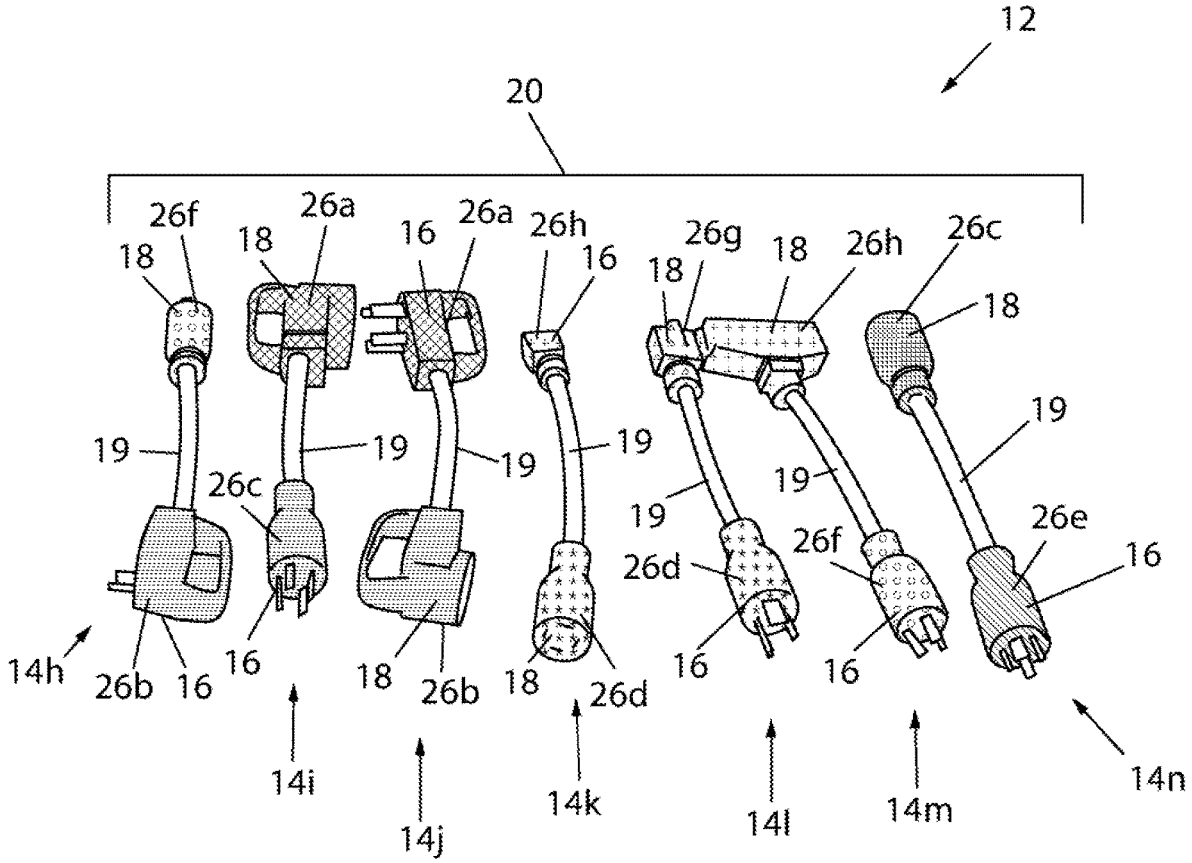

Referring now to FIGS. 2A and 2B, an exemplary electrical adapter system 12 is provided in accordance with the invention. The system 12 could include one or more electrical adapter power cords 14 (illustrated as fourteen adapter power cords 14*a*-14*n*). Each adapter power cord 14 can have a first end 16 having a male plug configured for a first type of electrical connection, and a second end 18 having a female receptacle configured for a second type of electrical connection. Being an adapter, for each power cord, the male plug of the first type is typically incompatible with the female receptacle of the second type such that the female receptacle cannot receive the male plug.

For each adapter power cord 14, the first end 16 can comprise a first indicia representing its configuration for adapting to the first type of connection, and the second end 18 can comprise a second indicia, different from the first indicia, representing its configuration for adapting to the second type of connection. The various indicia are identified in the drawings by reference numerals 26*a*-26*h* and are correspondingly illustrated with various hatching. For example, first and second differing colors could be selected from the group consisting of: orange (identified by 26*a*); grey (identified by 26*b*); clear (identified by 26*c*); red (identified by 26*d*); dark green (identified by 26*e*); purple (identified by 26*f*); blue (identified by 26*g*); and light green (identified by 26*h*). The power cord cable portion 19, which could comprise multiple electrical wires insulated from one another connecting the first and second ends 16 and 18 together, respectively, could comprise a third indicia that is further different from the first and second colors or patterns. For example, the power cord cable portion 19 could be black. In this manner, each adapter power cord 14 has a male end having one of the above-noted colors and a female end having a different one of the above-noted colors.

In one aspect, multiple different adapter power cords 14, each having unique end configurations for adapting to different types of connections in different ways, could be provided in a set or kit 20, such as the fourteen unique adapter power cords 14*a*-14*n* as illustrated in FIGS. 2A and 2B. For each adapter power cord 14, a first end 16 could be configured for a one type of connection, while a second end 18 could be configured for another type of connection, with the types of connection being incompatible with one another, such that they could not be connected together. For example, the first adapter power cord 14*a* could have a first end 16 configured with a male plug in which the end has a first indicia 26*a* (orange), configured for a one type of connection, such as National Electrical Manufacturers Association (NEMA) 14-50, and a second end 18 configured with a female receptacle in which the end has a second indicia 26*b* (grey), configured for another type of connection, such as NEMA TT 30, with the ends being incompatible with one another.

Also, ends of the adapter power cords 14 having the same type of connection, whether configured as a male plug or a female receptacle, can also have the same indicia. For example, the first adapter power cord 14*a* could have a first end 16 configured with a male plug in which the end has a first indicia 26*a* (orange), configured for one type of connection, such as NEMA 14-50, while the third adapter power cord 14*c* could have a second end 18 configured with a female receptacle which end also has the same first indicia 26*a* (orange), configured for the same type of connection, also NEMA 14-50. As a result, the different types of adapter power cords 14 in the set or kit 20 could be quickly, visually and readily distinguished by an observer based on the colors or patterns, thereby allowing the observer to rapidly select an appropriate adapter power cord 14 for adapting a given power source to a given electrical load.

In one aspect, adapter power cords 14 in the set or kit 20 could have NEMA connectors of various types at each of the ends, and corresponding colors or patterns matching such types. For example, an adapter power cord 14 having a male or female end configured for NEMA 14-50 could have that end being orange; an adapter power cord 14 having a male or female end configured for NEMA TT 30 could have that end being grey; an adapter power cord 14 having a male or female end configured for NEMA L14-30 could have that end being clear; an adapter power cord 14 having a male or female end configured for NEMA L5-30 could have that end being red; an adapter power cord 14 having a male or female end configured for NEMA L14-20 could have that end being dark green; an adapter power cord 14 having a male or female end configured for NEMA L5-20 could have that end being purple; an adapter power cord 14 having a male or female end configured for NEMA 5-20 could have that end being blue; and an adapter power cord 14 having a male or female end configured for NEMA 5-15 could have that end being light green. Accordingly, the types of connections at ends of adapter power cords 14 can differ, for example, with respect to connection orientation, length, pin out, voltage rating, and the like, whether according to NEMA standards or otherwise.

As an alternative to all of the adapter power cords 14 being available in a single kit 20, it is also contemplated that, in practice, each of the adapter cords 14*a*-14*h* could be made available separately, such as in a retail establishment or in a catalog or online purchasing environment. In this manner, a user can identify the connections required at the power source and at the load, and then quickly and easily visually identify and purchase only the adapter cord 14 wherein 1) a connector at one end is configured to engage the power source, typically a receptacle via an extension cord, and 2) a connector at the other end is configured to engage the load, typically a plug.

Figure 3:
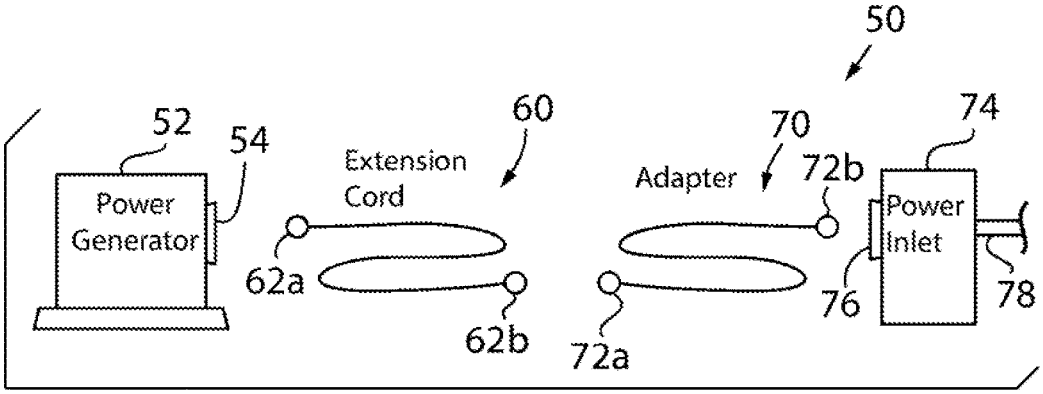
FIG. 3 illustrates an exemplar system comprising electrical power cords in accordance with an aspect of the invention.

Referring now to FIG. 3, an exemplar system 50 may comprise various electrical power cords provided in accordance with an aspect of the invention. At one end of the system 50, a power generator 52, which could be a gasoline powered generator, may be configured to provide electrical power to loads through an electrical outlet 54 (plug or receptacle). A first electrical power cord 60 having first and second ends 62*a* and 62*b*, respectively, in turn, may be configured to plug into the power generator 52 and distribute the power a distance away. Accordingly, the first electrical power cord 60 may be an "extension cord." At another end of the system 50, a power inlet 74, which may comprise a junction box configured to provide electrical power to various loads of a circuit 78, may be configured to receive electrical power at an electrical inlet 76 (plug or receptacle). However, in the system 50, the electrical outlet 54 and the electrical inlet 76 may be of different types that are incompatible with one another. Moreover, the first electrical power cord 60, while having a same type as the electrical outlet 54 at the first end 62*a*, typically does not match the type required by the electrical inlet 76 at the second end 62*b*, thereby causing a continuity problem.

Many different "types" or standards exist for electrical and mechanical connections. Types include male plugs and female receptacles. For a same type, a male plug and a female receptacle are electrically and mechanically compatible with one another such that the male plug and the female receptacle are plug compatible and electrically operational with one another. For different types, a male plug and a female receptacle may not be electrically and/or mechanically compatible with one another such that the male plug and the female receptacle may not be plug compatible and/or electrically operational with one another. Types can include, for example, National Electrical Manufacturers Association (NEMA) 14-50, NEMA Travel Trailer (TT) 30, NEMA L14-30, NEMA L5-30, NEMA L14-20, NEMA L5-20, NEMA 5-20 and NEMA 5-15.

To resolve the aforementioned continuity problem in the system 50, a second electrical power cord 70 having first and second ends 72*a* and 72*b*, respectively, configured with correct types for plugging into the first power cord 60 and the electrical inlet 76 at opposing ends. In particular, the first end 72*a* of the second electrical power cord 70 may be of a same type as the second end 62*b* of the first electrical power cord 60. Also, the second end 72*b* of the second electrical power cord 70 may be of a same type as the electrical inlet 76. As a result, the second electrical power cord 70 may complete the connection for transmitting power from the power generator 52, through the first and second electrical power cords 60 and 70, respectively, to the power inlet 74.

In accordance with the invention, each "type" has a corresponding pattern, color or sensory indicia, or "distinguishing mark," unique to that type. This allows each end of each electrical power cord to be marked with a distinguishing indicator indicating the given type for the end. Such differences in distinguishing mark corresponding to differences in electrical connection types can allow an observer to visually and quickly select a power cord adapter, including from a larger set of electrical power cord adapters, for adapting between a particular source and load requiring different types of electrical connections. For example, in the system 50, an observer need not be aware of the actual types required by the electrical outlet 54, the first electrical power cord 60, or the electrical inlet 76. Rather, the observer only needs to recognize the distinguishing marks (distinguishing indicators) of the second end 62*b* of the first electrical power cord 60 and the electrical inlet 76 and select a second electrical power cord 70 based on ends correspondingly matching such distinguishing marks.

Distinguishing indicators may comprise patterns, colors, molded-in patterns or shaped identifiers, shaped protrusions, or other sensory indicia, including visually different but with same colors, as described herein. In one aspect, distinguishing indicators may comprise colors, including orange, grey, clear, red, dark green, purple, blue, and light green. For example, an end having a male plug or female receptacle compatible with type NEMA 14-50 may each have a distinguishing indicator of orange, an end having a male plug or female receptacle compatible with type NEMA TT 30 type may each have a distinguishing indicator of grey, an end having a male plug or female receptacle compatible with type NEMA L14-30 may each have a distinguishing indicator of clear, an end having a male plug or female receptacle compatible with type NEMA L5-30 may each have a distinguishing indicator of red, an end having a male plug or female receptacle compatible with type NEMA L14-20 may each have a distinguishing indicator of dark green, an end having a male plug or female receptacle compatible with type NEMA L5-20 may each have a distinguishing indicator of purple, an end having a male plug or female receptacle compatible with type NEMA 5-20 may each have a distinguishing indicator of blue and an end having a male plug or female receptacle compatible with type NEMA 5-15 may each have a distinguishing indicator of light green.

Moreover, providing a non-distinguishing indicator between opposing ends of each electrical power cord, such as the color black, can provide further advantages. The non-distinguishing indicator between ends, such as along the insulated wire portion, can allow the distinguishing indicators at each end to be even more visibly apparent to an observer. Also, the non-distinguishing indicator between ends can provide a common standard among multiple electrical power cord in a kit, each electrical power having ends of differing distinguishing indicators.

Figure 4:
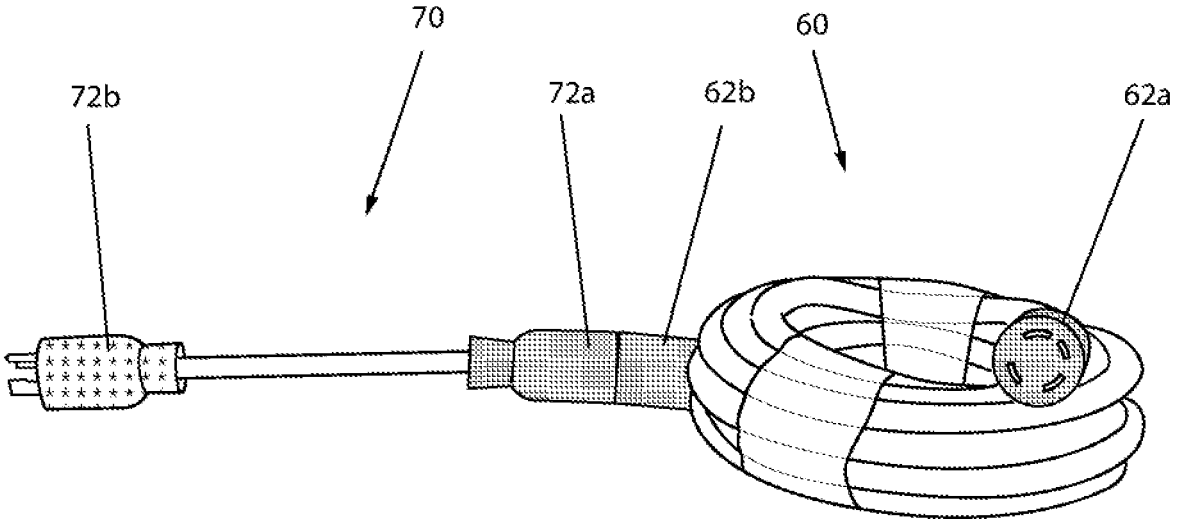
FIG. 4 illustrates exemplar first and second electrical power cords for use in the system of FIG. 3.

With additional reference to FIG. 4, exemplar first and second electrical power cords 60 and 70, respectively, plugged in and joined together, are provided in accordance with an aspect of the invention. In this example, the electrical outlet 54 may be a NEMA L14-30 type. Accordingly, the first and second ends 62*a* and 62*b*, respectively, of the first electrical power cord 60 may each correspond to the NEMA L14-30 type each having the distinguishing indicator of a clear end. However, the power inlet 74 may be a NEMA L5-30 type corresponding to a distinguishing indicator of red. To quickly adapt the power generator 52 to the power inlet 74, an observer can readily observe the distinguishing indicators of clear (illustrated by small squares) and red (illustrated by small stars) ends and locate a second electrical power cord 70 having such distinguishing indicators at such ends. That is, the observer can readily locate a second electrical power cord 70 having a distinguishing indicator of clear at the first end 72*a*, matching the second end 62*b* of the first electrical power cord 60, and a distinguishing indicator of red at the second end 72*b*, matching the power inlet 74. Accordingly, the second electrical power cord 70 may be an "adapter cord."

Figure 5:
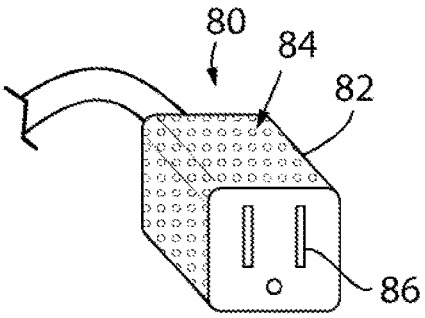
FIG. 5 illustrates an isometric view of an end of an exemplar electrical power cord having a female receptable and being of a first type in accordance with an aspect of the invention.
Figure 6:
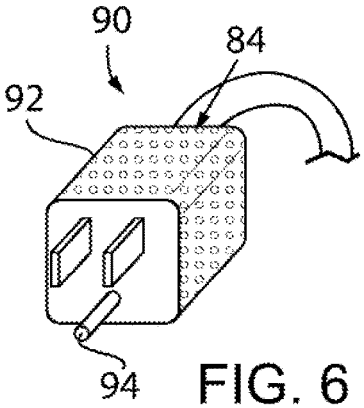
FIG. 6 illustrates an isometric view of an end of another exemplar electrical power cord having a male plug and being of the first type such that male plug is compatible with the female receptacle of FIG. 5 in accordance with an aspect of the invention.

Referring now to FIGS. 5 and 6, isometric views of exemplar ends of electrical power cords of a same type are provided in accordance with an aspect of the invention. In FIG. 5, an electrical power cord 80 may comprise an end 82 including a female receptacle of a first type, such as NEMA L5-20. The first type may be indicated by a corresponding distinguishing indicator 84 on a housing of the female receptacle, such as a color purple end illustrated by small circles. The female receptacle may comprise one or more ports 86 for receiving prongs from a male plug of the same type. With additional reference to FIG. 6, an electrical power cord 90 may comprise an end 92 including a male plug also of the first type, for example, NEMA LS-20. The first type may also be indicated by the corresponding distinguishing indicator 84 (same distinguishing indicator as the end 82) on a housing of the male plug, also a color purple end illustrated by small circles. The male plug may comprise one or more prongs 94 or blades for electrically and mechanically mating with the female receptacle at the end 82.

Figure 7:
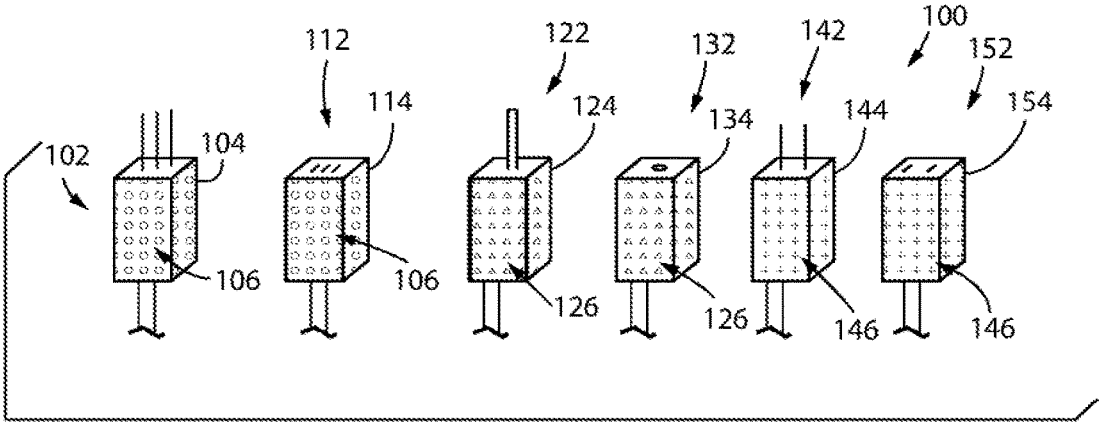
FIG. 7 illustrates an exemplar system comprising multiple electrical power cords of different types in accordance with an aspect of the invention.

Referring now to FIG. 7, a kit 100 of electrical power cords of different types is provided in accordance with an aspect of the invention. The kit 100 may comprise a first power cord 102 having an end 104 of a first type, such as NEMA L5-20, including a male plug. The end 104 may include a first distinguishing indicator 106 (a color purple end illustrated by small circles small) for identifying the first type. The kit 100 may also comprise a second power cord 112 having an end 114 of the first type, also NEMA L5-20, including a female receptacle. The end 114 may also include the first distinguishing indicator 106 (the color purple illustrated by small circles small) for identifying the first type. The male plug at the end 104 and the female receptacle at the end 114 being of the same type as indicated by the distinguishing indicator 106 confirms such ends are electrically and mechanically plug compatible with one another.

The kit 100 may further comprise a third power cord 122 having an end 124 of a second type, such as NEMA 5-20, including a male plug. The end 124 may include a second distinguishing indicator 126 (a color blue end illustrated by triangles) for identifying the second type. The kit 100 may also comprise a fourth power cord 132 having an end 134 of the second type, also NEMA 5-20, including a female receptacle. The end 134 may also include the second distinguishing indicator 126 (the color blue end illustrated by triangles) for identifying the second type. The male plug at the end 124 and the female receptacle at the end 134 being of the same type as indicated by the distinguishing indicator 126 confirms such ends are electrically and mechanically plug compatible with one another.

Also, the kit 100 may further comprise a fifth power cord 142 having an end 144 of a third type, such as NEMA 5-15, including a male plug. The end 144 may include a third distinguishing indicator 146 (a color light green end illustrated by small pluses) for identifying the third type. The kit 100 may also comprise a sixth power cord 152 having an end 154 of the third type, also NEMA 5-15, including a female receptacle. The end 154 may also include the third distinguishing indicator 146 (the color light green end illustrated by small pluses) for identifying the third type. The male plug at the end 144 and the female receptacle at the end 154 being of the same type as indicated by the distinguishing indicator 146 confirms such ends are electrically and mechanically plug compatible with one another. It should be appreciated that numerous electrical power cords can be similarly provided in the kit 100 using distinguishing indicators, typically comprising colors, corresponding to different combinations of standards at ends of the cords available in the kit.

Figure 8:
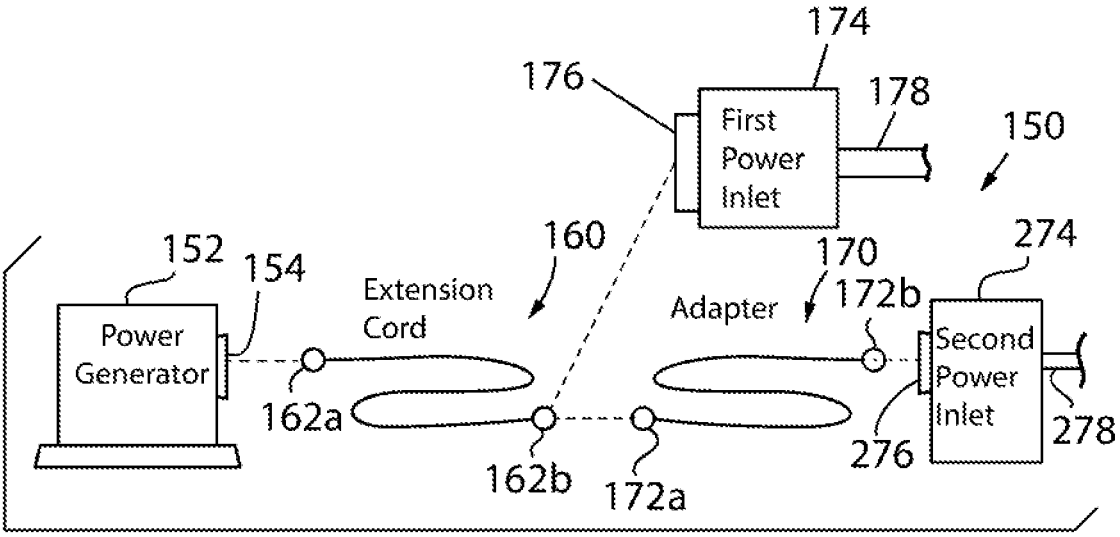
FIG. 8 illustrates an exemplar system comprising electrical power cords in accordance with another aspect of the invention.

Referring now to FIG. 8, in accordance with another aspect of the invention, an exemplar system 150 may comprise various electrical power cords provided in accordance with an aspect of the invention. At one end of the system 150, a power generator 152, which could be a gasoline powered generator, may be configured to provide electrical power to loads through an electrical outlet 154 (plug or receptacle). A first electrical power cord 160 having first and second ends 162*a* and 162*b*, respectively, in turn, may be configured to plug into the power generator 152 and distribute the power a distance away to a power receiving unit. In particular, the first end 162*a* of the first electrical power cord 160 may be configured to plug into the power generator 152, while the second end 162*b* of the first electrical power cord 160 may be configured to plug into an electrical inlet 176 (plug or receptacle) of a first power inlet 174, which may comprise a junction box configured to provide electrical power to various loads of a first circuit 178, such as conventional household loads. Accordingly, the first electrical power cord 160 may be a "generator extension cord."

However, it may be desirable at times to instead connect the power from the power generator 152 to an electrical inlet of different types that is incompatible with the first electrical power cord 160, such as an electrical inlet 276 (plug or receptacle) of a second power inlet 274, which may comprise a junction box of a different standard configured to provide electrical power to various loads of a second circuit 278, such as 3-phase power. Such a circumstance could occur, for example, during a power outage. However, this causes a continuity problem as the second end 162*b* of the first electrical power cord 160 does not match the type required by the electrical inlet 276.

To resolve this continuity problem in the system 150, a user need only acquire a second electrical power cord 170 having first and second ends 172*a* and 172*b*, respectively, configured with correct types for plugging into the first power cord 160 and the second electrical inlet 276 at opposing ends. In particular, the first end 172*a* of the second electrical power cord 170 may be of a same type as the second end 162*b* of the first electrical power cord 160. Also, the second end 172*b* of the second electrical power cord 170 may be of a same type as the second electrical inlet 276. As a result, the second electrical power cord 170 may complete the connection for transmitting power from the power generator 152, through the first and second electrical power cords 160 and 170, respectively, to the second power inlet 274. Advantageously, an owner need not be aware of the actual types required by the electrical outlet 154, the first electrical power cord 160, or the second electrical inlet 276. Rather, the owner only needs to recognize the distinguishing marks (distinguishing indicators) of the second end 162*b* of the first electrical power cord 160 and the electrical inlet 276 and select a second electrical power cord 170 based on ends correspondingly matching such distinguishing marks. Accordingly, the second electrical power cord 170 may be an "adapter cord."

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An electrical adapter system comprising:

first and second electrical power cords, each electrical power cord having first and second ends, wherein the first and second ends of the first electrical power cord define distal ends of the first power cord, and wherein the first and second ends of the second electrical power cord define distal ends of the second power cord, each end including a male plug or a female receptacle, the male plug or female receptable of each end having a given electrical connection configuration among a plurality of different electrical connection configurations in which a male plug and a female receptacle of a same electrical connection configuration are plug compatible with one another and a male plug and a female receptacle of different electrical connection configurations are incompatible with one another, each electrical connection configuration corresponding to a distinguishing indicator, and each end having a distinguishing indicator corresponding to the given electrical connection configuration, wherein the first and second ends of the first electrical power cord and the first end of the second electrical power cord are of a same electrical connection configuration having the same distinguishing indicators while the second end of the second electrical power cord is of a different electrical connection configuration having a different distinguishing indicator, and wherein the second end of the first electrical power cord is plug compatible with the first end of the second electrical power cord of the same electrical connection configuration for transmitting power from the first end of the first electrical power cord to the second end of the second electrical power cord.

2. The electrical adapter system of claim 1, wherein the distinguishing indicators comprise color indicators.

3. The electrical adapter system of claim 1, wherein each electrical connection configuration differs with respect to a connection orientation which prevents male plugs of a selected electrical connection configuration from being plug compatible with female receptacles of different electrical connection configurations.

4. The electrical adapter system of claim 1, wherein each electrical connection configuration differs with respect to voltage rating.

5. The electrical adapter system of claim 1, wherein the plurality of electrical connection configurations comprise National Electrical Manufacturers Association (NEMA) 14-50, NEMA Travel Trailer (TT) 30, NEMA L14-30, NEMA L5-30, NEMA L14-20, NEMA L5-20, NEMA 5-20 and NEMA 5-15.

6. The electrical adapter system of claim 1, wherein each electrical power cord comprises a plurality of electrical wires insulated from one another.

7. A method for adapting power in an electrical system, comprising:

providing first and second electrical power cords, each electrical power cord having first and second ends, wherein the first and second ends of the first electrical power cord define distal ends of the first power cord, and wherein the first and second ends of the second electrical power cord define distal ends of the second power cord, each end including a male plug or a female receptacle, the male plug or female receptacle of each end having a given electrical connection configuration among a plurality of different electrical connection configurations in which a male plug and a female receptacle of a same electrical connection configuration are plug compatible with one another and a male plug and a female receptacle of different electrical connection configurations are incompatible with one another, each electrical connection configuration corresponding to a distinguishing indicator, and each end having a distinguishing indicator corresponding to the given electrical connection configuration, wherein the first and second ends of the first electrical power cord and the first end of the second electrical power cord are of a same electrical connection configuration having the same distinguishing indicators while the second end of the second electrical power cord is of a different electrical connection configuration having a different distinguishing indicator, and wherein the second end of the first electrical power cord is plug compatible with the first end of the second electrical power cord of the same electrical connection configuration for transmitting power from the first end of the first electrical power cord to the second end of the second electrical power cord.

8. The method of claim 7, wherein the distinguishing indicators comprise color indicators.

9. The method of claim 7, further comprising each electrical connection configuration differing with respect to a connection orientation which prevents male plugs of a selected electrical connection configuration from being plug compatible with female receptacles of different electrical connection configurations.

10. The method of claim 7, further comprising each electrical connection configuration differing with respect to voltage rating.

11. The method of claim 7, further comprising the plurality of electrical connection configurations comprise National Electrical Manufacturers Association (NEMA) 14-50, NEMA Travel Trailer (TT) 30, NEMA L14-30, NEMA L5-30, NEMA L14-20, NEMA L5-20, NEMA 5-20 and NEMA 5-15.

12. The method of claim 7, further comprising each electrical power cord comprising a plurality of electrical wires insulated from one another.

* * * * *